US007708088B2

(12) United States Patent
Allahar et al.

(10) Patent No.: US 7,708,088 B2
(45) Date of Patent: May 4, 2010

(54) VIBRATING DOWNHOLE TOOL

(75) Inventors: Ian Allahar, Houston, TX (US); Jose Mercado, Humble, TX (US); Charles Grigor, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 12/111,824

(22) Filed: Apr. 29, 2008

(65) Prior Publication Data

US 2009/0266612 A1 Oct. 29, 2009

(51) Int. Cl.
*E21B 7/24* (2006.01)

(52) U.S. Cl. ..... 175/55; 175/56

(58) Field of Classification Search ..... 175/55, 175/56, 107, 296
See application file for complete search history.

(56) References Cited

U.S. PATENT DOCUMENTS 2,554,005 A * 5/1951 Bodine, Jr. ..... 175/55
2,744,721 A * 5/1956 Hatch ..... 415/121.2
3,450,217 A * 6/1969 Wise ..... 175/56
3,532,174 A * 10/1970 Hinks et al. ..... 175/56
3,807,512 A * 4/1974 Pogonowski et al. ..... 175/106

FOREIGN PATENT DOCUMENTS

GB 2261238 A * 5/1993
RU 2038461 C1 * 6/1995
SU 1633087 A * 3/1991

OTHER PUBLICATIONS

International Search Report and Written Opinion of the International Searching Authority for corresponding International application # PCT/US2009/042111 dated Dec. 21, 2009, 13 pages.

* cited by examiner

*Primary Examiner*—Daniel P Stephenson
(74) *Attorney, Agent, or Firm*—Osha Liang LLP

(57) ABSTRACT

A vibrating downhole tool comprising a housing, an inner mandrel disposed within the housing and configured to receive a drilling fluid, a mass coupled to the inner mandrel, and a plurality of turbine blades configured to receive the drilling fluid and to rotate the inner mandrel and the mass, thereby causing the vibrating downhole tool to vibrate.

20 Claims, 3 Drawing Sheets

VIBRATING DOWNHOLE TOOL

BACKGROUND

1. Field of the Disclosure

Embodiments disclosed herein relate generally to apparatus and methods for creating a vibration within a wellbore. Specifically, the present disclosure relates to a vibrating downhole tool configured to vibrate equipment located within a wellbore.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earth formation and proceeds to form a borehole along a predetermined path toward a target zone. As the drill bit creates the wellbore, the drill string and/or the drill bit may become stuck within the wellbore. This may be due to the drill string contacting a wall of the wellbore, particles collapsing on and surrounding the drill bit, or any other situation known in the art.

Typically, when the drill bit and/or drill string becomes stuck, a jar that is coupled to the drill string may be used to free the drill bit and/or the drill string. The jar is a device used downhole to deliver an impact load to another downhole component, especially when that component is stuck. There are two primary types of jars, hydraulic and mechanical. While their respective designs are different, their operation is similar. Energy is stored in the drillstring and suddenly released by the jar when it fires, thereby imparting an impact load to a downhole component.

Additionally, during certain oil and gas operations, downhole components (e.g., packers, anchors, liners, etc.) may become stuck within a wellbore. Typically, a fishing tool that may include a jar, a drill collar, a bumper sub, and an overshot is used to retrieve a downhole component that is stuck. During the retrieval operation, the fishing tool is lowered into a wellbore to a depth near the downhole component. Typically, the overshot is then used to grapple the downhole component. Next, a force (e.g., an impact load) is applied to the downhole component through the use of the jar, which may free the stuck downhole component. The fishing tool may then transport the downhole component to the surface of the wellbore.

Accordingly, there exists a need for methods and apparatuses for improving drilling and retrieval operations in the oil and gas industry.

SUMMARY OF THE DISCLOSURE

In one aspect, embodiments of the present disclosure relate to a vibrating downhole tool comprising a housing, an inner mandrel disposed within the housing and configured to receive a drilling fluid, a mass coupled to the inner mandrel, and a plurality of turbine blades configured to receive the drilling fluid and to rotate the inner mandrel and the mass, thereby causing the vibrating downhole tool to vibrate.

In another aspect, embodiments of the present disclosure relate to a drilling tool assembly comprising a drill string, a drill bit coupled to the drillstring, and at least one vibrating downhole tool coupled to the drill string, the vibrating downhole tool comprising a housing, an inner mandrel configured to receive a drilling fluid, a mass coupled to the inner mandrel, and a plurality of turbine blades configured to receive the drilling fluid and to rotate the inner mandrel and the mass, thereby causing the vibrating downhole tool to vibrate.

In yet another aspect, embodiments of the present disclosure relate to a method of activating a vibrating downhole tool comprising pumping a fluid downhole through a drill string to the vibrating downhole tool, and selectively activating the vibrating downhole tool by actuating a flow control device proximate the vibrating downhole tool, thereby allowing the fluid to flow through the vibrating downhole tool.

Finally, embodiments of the present disclosure relate to a method of freeing drilling equipment stuck within a wellbore comprising pumping a fluid downhole through a drill string, diverting the fluid to flow through a plurality of turbine blades of the vibrating downhole tool, rotating a inner mandrel and a mass through the use of the plurality turbine blades, and vibrating at least one component of the drill string.

Other aspects and advantages of the invention will be apparent from the following description and the appended claims.

DETAILED DESCRIPTION

In one aspect, embodiments disclosed herein relate to apparatuses and methods for creating a vibration within a wellbore. Specifically, the present disclosure relates to a vibrating downhole tool configured to vibrate equipment within a wellbore. During operation, the vibrating downhole tool may divert the flow of a drilling fluid through a device that may be configured to rotate at least one component of the vibrating downhole tool, which may cause the vibrating downhole tool to vibrate. Subsequently, the equipment that may be coupled to the vibrating downhole tool may also vibrate.

Figure 1:
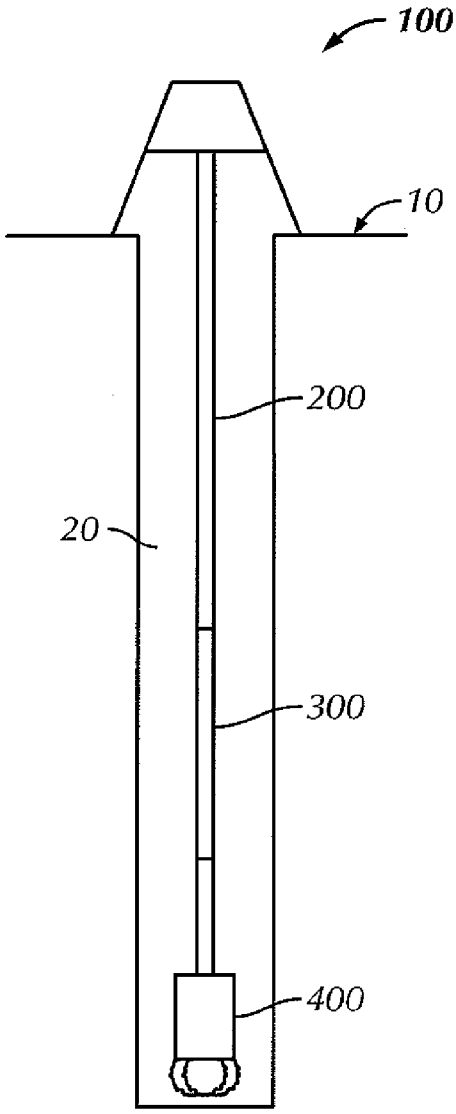
FIG. 1 shows a drilling system in accordance with embodiments of the present disclosure.

Referring now to FIG. 1, a drilling system 100 in accordance with embodiments of the present disclosure is shown. The drilling system 100 includes a drill string 200, a vibrating downhole tool 300, and a drill bit 400. The drilling system 100 is configured to drill a wellbore 20 and create a vibration that may be transferred into the drill string 200 and/or the drill bit 400 located below a surface of the wellbore 10. One of ordinary skill in the art will appreciate that the drill system 100 may include other tools, such as stabilizer, motors, etc.

The drill string 200 is coupled to the vibrating downhole tool 300 and the drill bit 400. As known to one skilled in the art the vibrating downhole tool 300 and the drill bit may be coupled to the drill string 200 through the use of threads, bolts, welds, or any other attachment feature known in the art. Further, the drill string 200 is configured to transfer a drilling fluid downhole to the vibrating downhole tool 300 and the drill bit 400. For example, the drill string 200 may include at least one drill pipe (not shown) having a bore (not shown) that allows the drilling fluid to pass through the drillstring 200.

The drill bit 400 is configured to crush or shear particles located at the bottom of the wellbore 20, thereby increasing the depth of the wellbore 20. In one embodiment, the drill bit 400 may include a fixed cutter drill bit configured to shear the particles at the bottom of the wellbore 20. In another embodiment, the drill bit 400 may include a roller cone bit configured to crush particles at the bottom of the wellbore 20.

Figure 2A:
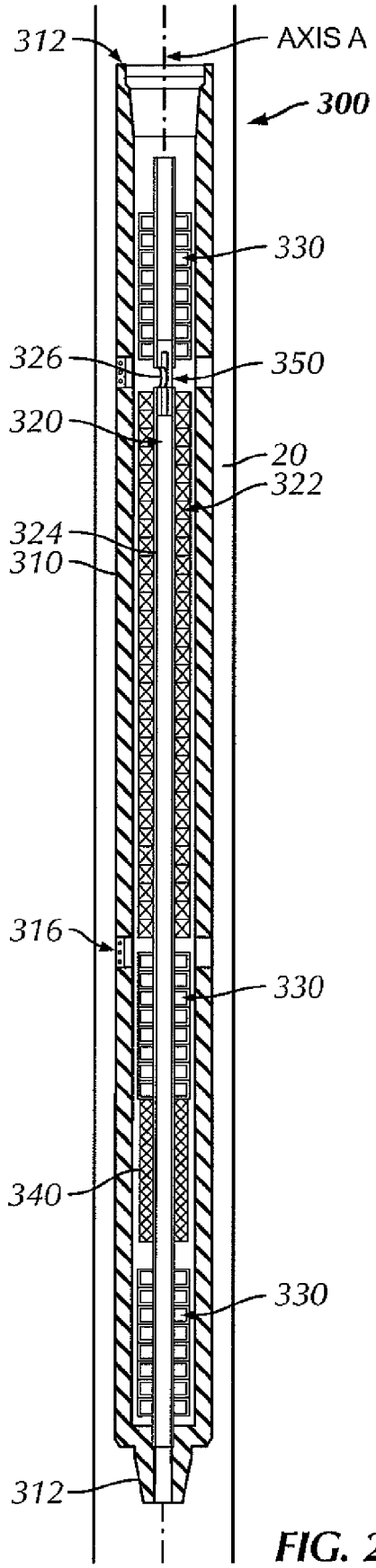
FIG. 2A shows a cross-sectional view of a vibrating downhole tool in accordance with embodiments of the present disclosure.

Referring now to FIG. 2A, a cross-sectional view of the vibrating downhole tool 300 is shown. The vibrating downhole tool 300 is configured to receive the drilling fluid and create a vibration. The vibrating downhole tool 300 includes a housing 310 with connections 312, which allows the vibrating downhole tool 300 to be coupled to the drill string 200 and/or the drill bit 400. Further, the vibrating downhole tool 300 includes an inner mandrel 320, bearings 330, a mass 340, and a flow control device 350.

The inner mandrel 320 extends through a bore 314 of the housing 310 and is configured to receive and transfer a drilling fluid through the vibrating downhole tool 300. Additionally, in one embodiment, the inner mandrel 320 may include a plurality of turbine blades 322 disposed on an outer surface 324 of the inner mandrel 320. Furthermore, in certain embodiments, the inner mandrel 320 may include an opening 326 that allows at least a portion of the drilling fluid flowing through the inner mandrel 320 to flow through the plurality of turbine blades 322, thereby causing the inner mandrel 320 to rotate around axis A.

As depicted, the housing 310 is configured to protect and contain components (i.e., bearings, inner mandrel, mass, etc.) of the vibrating downhole tool 300. Furthermore, the housing 310 may also include at least one annular port 316 that provides a path for at least a portion of the drilling fluid to be released from the vibrating downhole tool 300. For example, during operation, at least a portion of the drilling fluid may pass through the opening 326 in the inner mandrel 320 and through the plurality of turbine blades 322. Once the drilling fluid has passed through the plurality of turbine blades 322, it may then pass through the annular port 316 and into the wellbore 20.

As shown, the bearings 330 are disposed between the inner mandrel 320 and the housing 310. The bearings 330 are configured to allow the inner mandrel 320 to rotate independently from the housing 310. The bearings 330 may include ball bearings, fluid bearings, jewel bearings, or other bearings known in the art.

Figure 2B:
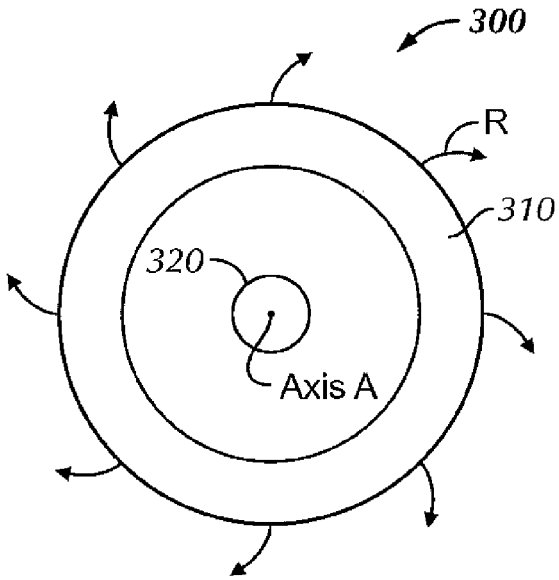
FIG. 2B shows a top view of a vibrating downhole tool in accordance with embodiments of the present disclosure.

Further, as shown, the mass 340 is coupled to the inner mandrel 320 of the vibrating downhole tool 300. The mass 340 may be coupled to the inner mandrel 320 by bolts, welding, or any other attachment method known in the art. As such, the mass 340 is configured to be rotated around axis A by the inner mandrel 320. In one embodiment, the mass 340 may be eccentric. As used herein, "eccentric" refers to a mass having a center of gravity that is offset from an axis that the mass is rotated around (e.g., axis A). As the eccentric mass 340 is rotated by the inner mandrel 320, a centrifugal force created by a rotation of the eccentric mass 320 may cause the vibrating downhole tool 300 to be displaced. In one embodiment, the rotation of the eccentric mass causes the vibrating downhole tool to be displaced in an outward direction R, as shown in FIG. 2B. Consequently, the displacement of the vibrating downhole tool 300 creates a radial and/or axial vibration, which may be used to vibrate the drill string 200 or other components disposed within the wellbore 20, such as, the drill bit 400. In certain embodiments, the mass 340 may include at least one aperture (not shown) that will allow inserts (not shown) to be added and removed from the mass 340, thereby allowing a weigh to the mass 340 to be increased.

Figure 3:
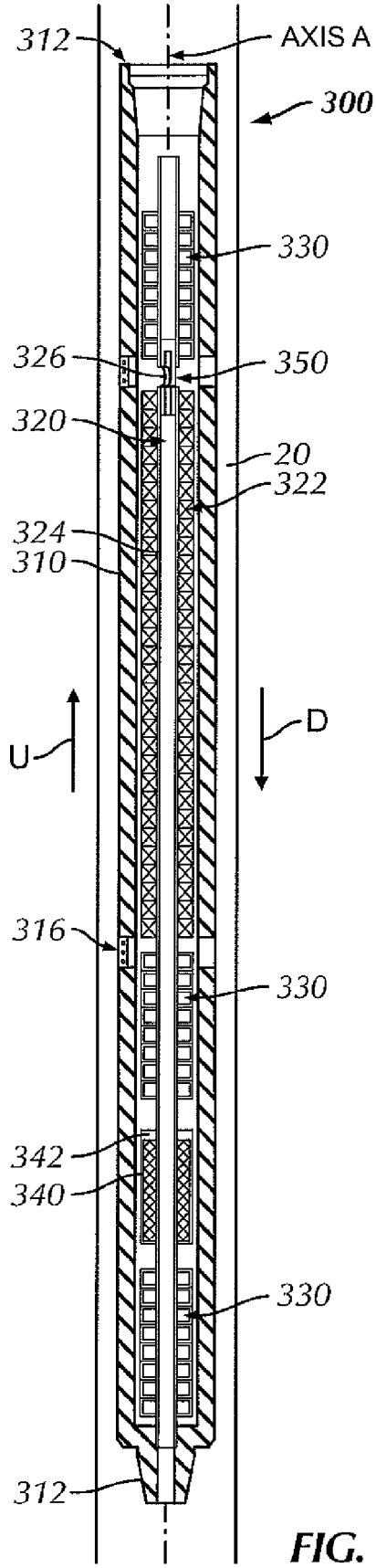
FIG. 3 shows a cross-sectional view of a vibrating downhole tool in accordance with embodiments of the present disclosure.

Referring now to FIG. 3, in select embodiments, the mass 340 may include a sleeve 342 configured to translate in an upward direction U and a downward direction D as the mass 340 is rotated. The upward and downward translation of the sleeve 342 may cause the vibrating downhole tool 300 to be displaced in the upward and downward direction U, D. Accordingly, the displacement of the vibrating downhole tool 300 creates a vibration that may be used to axially vibrate the drill string 200 and/or other components within the wellbore 20.

Referring back to FIG. 2A, the flow control device 350 is configured to control the flow of the drilling fluid through the inner mandrel 320 and through the plurality of turbine blades 322. Accordingly, during operation, the flow control device 350 may be used to selectively activate the vibrating downhole tool. In one embodiment, the flow control device 350 may include a ball drop nozzle (not shown) configured to receive a neoprene ball or a ball of any other material known in the art. During operation, the neoprene ball may be pumped down the drill string 200 and seated in the ball drop nozzle. Consequently, the drilling fluid may flow through the opening 326 in the inner mandrel 320 and through the plurality of turbine blades 322.

In another embodiment, the flow control device 350 may include a valve (not shown) configured to control the flow of the drilling fluid through the inner mandrel 320 and the opening 326 in the inner mandrel 320. For example, the valve may be positioned proximate the opening 326 and actuated to direct at least a portion of the drilling fluid in the inner mandrel 320 through the opening 326. The drilling fluid may then flow through the plurality of turbine blades 322 and through at least one annular port 316 of the housing 310.

In certain embodiments, the flow control device 350 may include an RFID Tag (not shown) that may be used to control the flow control device 350. For example, a controller (not shown) may be electronically coupled to the RFID tag. Further, the controller may send a signal to the flow control device 350 that may be received by the RFID tag and used to actuate the flow control device 350, thereby diverting at least a portion of the drilling fluid through the opening 326 in the inner mandrel 320. Additionally, in some embodiments, the flow control device 350 may include a sensor that receives a signal from the RFID tag that may be used to actuate the flow control device 350.

Referring to FIGS. 1 and 2A, during operation of the drilling system 100, the drilling fluid is pumped through the drill string 200 to the vibrating downhole tool 300 located below the surface 10. The drilling fluid then flows into the inner mandrel 320 of the vibrating downhole tool 300. Next, the inner mandrel 320 transfers the drilling fluid through the vibrating downhole tool 300. While the drilling fluid is being transferred through the vibrating downhole tool 300, the flow control device 350 may be selectively actuated to divert a portion of the drilling fluid through the opening 326 of the inner mandrel 320. The diverted portion of drilling fluid will then flow through the plurality of turbine blades 322, thereby causing the inner mandrel 320 and mass 340 to rotate. Consequently, the vibrating downhole tool 300 will be displaced, which will cause the vibrating downhole tool 300 to vibrate. One skilled in the art will appreciate that the vibration created by the vibrating downhole tool 300 may be used to vibrate the drillstring 200 and/or other components, such as the drill bit 400. After the diverted portion of drilling fluid has passed through the plurality of turbine blades 322, the diverted portion of drilling fluid flows through the annular port 316 of the housing 310 and into the wellbore 20. In one embodiment, the drilling fluid that is allowed to pass through the vibrating downhole tool 300 flows into the drill string 200 below the vibrating downhole tool 300 and onto the drill bit 400 located at the bottom of the wellbore 20. In an alternate embodiment, the drilling fluid that is allowed to pass through the vibrating downhole tool 300 flows directly into the drill bit 400.

In certain embodiments, during operation, the flow control device 350 may control a flow rate of the portion of the drilling fluid passing through the plurality of turbine blades 322. In one embodiment, the flow control device 350 may be further actuated to increase the flow rate of the portion of the drilling fluid passing through the plurality of turbine blades 322. In another embodiment, the flow control device 350 may be de-actuated to decrease the flow rate of the portion of drilling fluid passing through the plurality of turbine blades 322.

As known by one skilled in the art, controlling the flow rate of the portion of drilling fluid passing through the plurality of turbine blades 322 may allow a frequency of the vibration created by the vibrating downhole tool to be controlled. For example, as the flow rate of the portion of the drilling fluid passing through the plurality of turbines 322 increases, a rotational speed of the mass 340 coupled to the inner mandrel 320 increases. As the rotational speed of the mass 340 increases, the vibrating downhole tool 300 may be displaced more often over a certain period of time, thereby increasing the frequency of vibrations created by the vibrating downhole tool 300.

Further, in certain embodiments, the vibrating downhole tool 300 may include a motor (not shown), such as a positive displacement motor (PDM), an electric motor, or any other motor known in the art. The motor may configured to selectively rotate the inner mandrel 320 and the mass 340, thereby selectively activating the vibrating downhole tool 300 during operation. In one embodiment, the motor may be coupled to the inner mandrel 320 and the mass 340 and a power supply (not shown). As such, the power supply may selectively provide the motor with an electric power, which may be used to rotate the motor, thereby causing the vibrating downhole tool 300 to vibrate.

Figure 4:
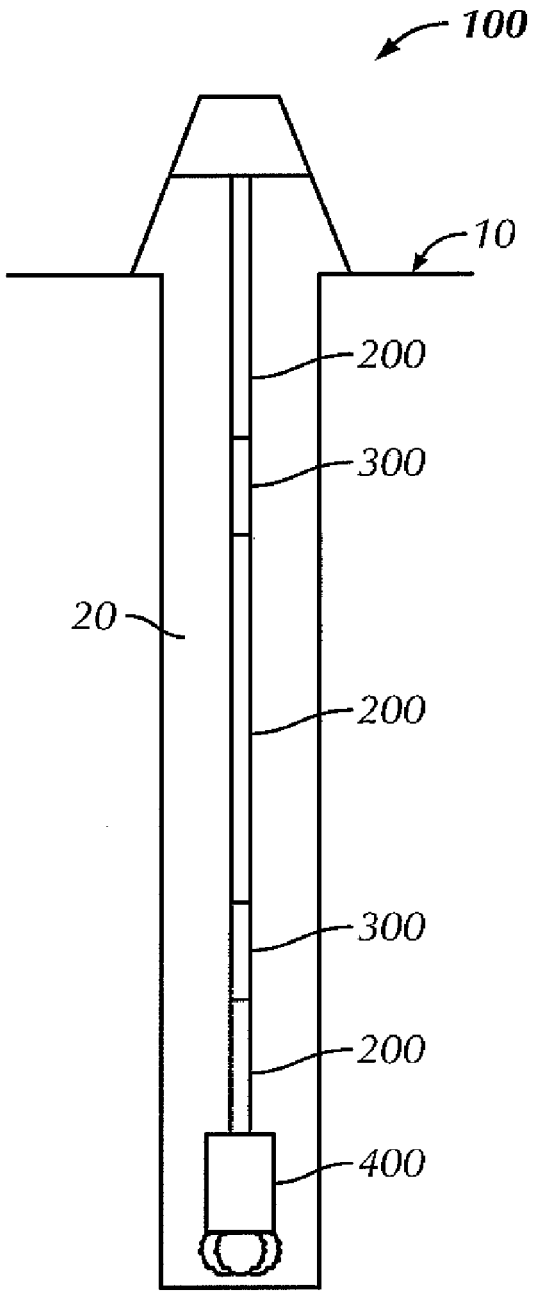
FIG. 4 shows a drilling system in accordance with embodiments of the present disclosure.

Furthermore, in certain embodiments, the drilling system 100 may include a plurality of vibrating downhole tools 300 coupled to the drill string 200 and positioned at various depths within the wellbore 20, as shown in FIG. 4. This may allow the drilling system 100 to selectively vibrate various sections of the drill string 200. Additionally, one skilled in the art will appreciate that when at least one of the plurality of vibrating downhole tools 300 is inoperable, another of the plurality of vibrating downhole tools 300 may be used to vibrate the drill string 200, thereby increasing the reliability of the drilling system 100.

Figure 5:
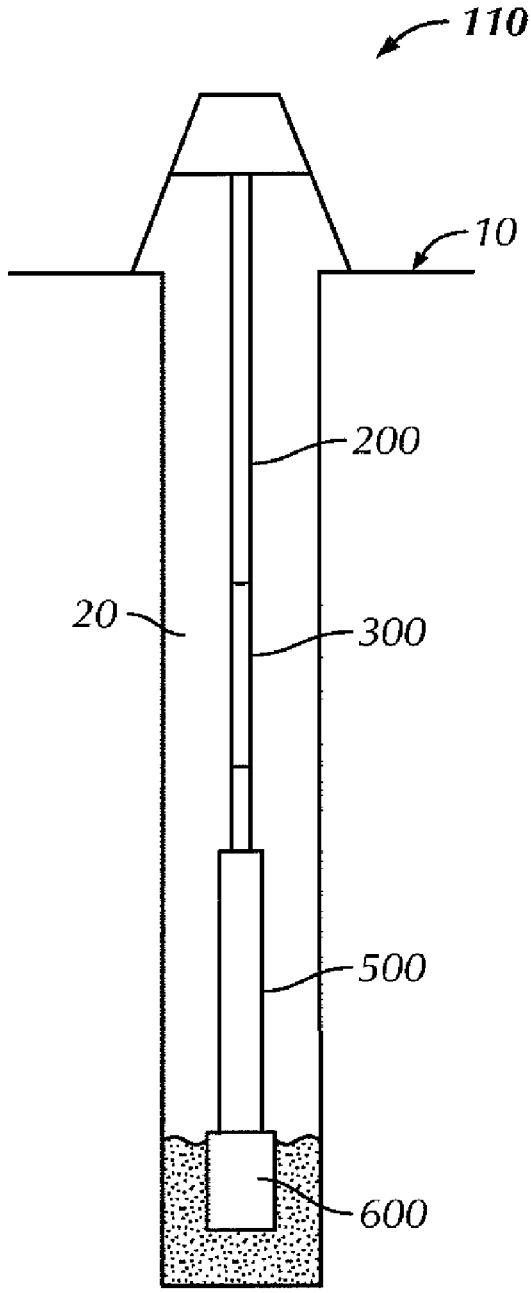
FIG. 5 shows a fishing system in accordance with embodiments of the present disclosure.

During oil and gas operations, downhole components (e.g., packers, anchors, liners, etc.) may become stuck within the wellbore. Accordingly, one skilled in the art will appreciate that the vibrating downhole tool 300 may be incorporated within a fishing system to retrieve a downhole component that is stuck. For example, referring now to FIG. 5, a fishing system 110 in accordance in with embodiments of the present disclosure is shown. In one embodiment, the fishing system 110 includes a fishing tool 500, a drill string 200, and a vibrating downhole tool 300. The drill string 200 is configured to transport a fluid downhole to the fishing tool 500 and/or the vibrating downhole tool 300. Generally, as known to one skilled in the art, the fishing tool 500 includes a jar (not shown), a drill collar (not shown), a bumper sub (not shown), and an overshot (not shown) configured to retrieve at least one piece of downhole equipment 600. As described above, the vibrating downhole tool 300 is configured to receive the fluid from the drill string 200 and create a vibration. During operation, the vibrating downhole tool 300 may be configured to receive the fluid pumped downhole through the drill string 200. Further, the vibrating downhole tool 300 may vibrate the drill string 200 and/or the at least one piece of downhole equipment 600 that is stuck to assist the fishing tool 500 in freeing and retrieving the at least one piece downhole equipment 600.

Advantageously, embodiments of the present disclosure may improve movement of equipment within a wellbore during operations. The vibration created by the vibrating downhole tool may displace the drillstring away from the wall of the wellbore, thereby reducing the friction between the wall of the wellbore and the drill string. Because the friction between the wall of the wellbore and the drill string is reduced the drill string may move more easily within the wellbore. Further, the vibration may also displace the downhole component attached to the drill string. In one example, this may prevent the downhole components (i.e., drill bit, stuck pieces of equipment) from getting stuck during operation.

Additionally, embodiments of the present disclosure provide a system configured to retrieve a downhole component stuck within a wellbore. The vibration created by the vibrating downhole tool of the system may displace the downhole component, which may assist in freeing the downhole equipment stuck within the wellbore.

Furthermore, embodiments of the present disclosure may provide a vibrating downhole tool configured to be selectively activated during operation. The vibrating downhole tool may include a device (e.g., flow control device) configured to be actuated, thereby activating the vibrating downhole tool.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A vibrating downhole tool comprising:

a housing;

an inner mandrel disposed within the housing and configured to receive a drilling fluid;

a mass coupled to the inner mandrel; and a plurality of turbine blades configured to receive the drilling fluid and to rotate the inner mandrel and the mass, thereby causing the vibrating downhole tool to vibrate;

a sliding sleeve coupled to the mass and configured to axially reciprocate to provide axial displacement of the downhole tool.

2. The vibrating downhole tool of claim 1, comprising a flow control device configured to control the flow of the drilling fluid through the plurality of turbine blades and the inner mandrel.

3. The vibrating downhole tool of claim 2, wherein the flow control device includes one of the group consisting of a valve and a drop ball nozzle.

4. The vibrating downhole tool of claim 1, comprising at least one bearing disposed between the inner mandrel and housing.

5. The vibrating downhole tool of claim 1, wherein the housing includes an annular port configured to allow the drilling fluid to be released from the vibrating downhole tool.

6. The vibrating downhole tool of claim 1, wherein the sliding sleeve is configured to translate along an axis of the inner mandrel as the mass is rotated.

7. The vibrating downhole tool of claim 1, wherein a rotation of the mass is configured to vibrate the downhole tool.

8. A drilling tool assembly comprising:

a drill string;

a drill bit coupled to the drillstring; and at least one vibrating downhole tool coupled to the drill string, the vibrating downhole tool comprising:

a housing;

an inner mandrel configured to receive a drilling fluid;

a mass coupled to the inner mandrel;

a plurality of turbine blades configured to receive the drilling fluid and to rotate the inner mandrel and the mass, thereby causing the vibrating downhole tool to vibrate; and a sliding sleeve coupled to the mass and configured to axially reciprocate to provide axial displacement of the downhole tool.

9. The drilling assembly of claim 8, further comprising a jar coupled to the drill string.

10. The drilling assembly of claim 8, further comprising a flow control device configured to control the flow of the drilling fluid through the turbine of the vibrating downhole tool.

11. The drilling assembly of claim 8, wherein the flow control device includes one of a group consisting of a valve and a drop ball nozzle.

12. A method of activating a vibrating downhole tool, the method comprising;

pumping a fluid downhole through a drill string to the vibrating downhole tool; and selectively activating the vibrating downhole tool by actuating a flow control device proximate the vibrating downhole tool, thereby allowing the fluid to flow through the vibrating downhole tool;

axially reciprocating a sliding sleeve along an axis of an inner mandrel of the vibrating downhole tool.

13. The method of claim 12, wherein the flow control device comprises one of the group consisting of a valve and a drop ball nozzle.

14. The method of claim 12, further comprising rotating a mass by allowing the fluid to pass through a plurality of turbine blades, thereby causing the vibrating downhole tool to vibrate.

15. A method of freeing drilling equipment stuck within a wellbore, the method comprising:

pumping a fluid downhole through a drill string;

diverting the fluid to flow through a plurality of turbine blades of the vibrating downhole tool;

rotating an inner mandrel and a mass through the use of the plurality of turbine blades;

axially reciprocating a sliding sleeve coupled to the mass; and vibrating at least one component of the drill string.

16. The method of claim 15, further comprising actuating a flow control device configured to selectively divert the fluid to flow through the plurality of turbine blades.

17. The method of claim 15, further comprising increasing a flow rate of the fluid through the plurality of turbine blades, thereby increasing a frequency of vibration of the at least one drill pipe.

18. The method of claim 15, further comprising reducing a flow rate of the fluid through the plurality of turbine blades, thereby decreasing a frequency of vibration of the at least one drill pipe.

19. The method of claim 15, further comprising providing the at least one component of the drill string with a radial vibration.

20. The method of claim 15, further comprising releasing the fluid from the vibrating downhole tool through an annular port into a well bore.

* * * * *